US010514171B2

(12) United States Patent
Wagner et al.

(10) Patent No.: US 10,514,171 B2
(45) Date of Patent: Dec. 24, 2019

(54) 3D NON-AXISYMMETRIC COMBUSTOR LINER

(71) Applicant: United Technologies Corporation, Farmington, CT (US)

(72) Inventors: Joel H. Wagner, Wethersfield, CT (US); Paul M. Lutjen, Kennebunkport, ME (US)

(73) Assignee: United Technologies Corporation, Farmington, CT (US)

( * ) Notice: Subject to any disclaimer, the term of this patent is extended or adjusted under 35 U.S.C. 154(b) by 792 days.

(21) Appl. No.: 15/195,383

(22) Filed: Jun. 28, 2016

(65) Prior Publication Data

US 2016/0305664 A1 Oct. 20, 2016

Related U.S. Application Data

(63) Continuation of application No. 14/202,969, filed on Mar. 10, 2014, now abandoned, which is a continuation of application No. 12/709,951, filed on Feb. 22, 2010, now Pat. No. 8,707,708.

(51) Int. Cl.

| | |
|---|---|
| ***F23R 3/16*** | (2006.01) |
| ***F23C 3/00*** | (2006.01) |
| ***F23R 3/00*** | (2006.01) |
| ***F23R 3/50*** | (2006.01) |

(52) U.S. Cl.

CPC ..... *F23R 3/16* (2013.01); *F23C 3/00* (2013.01); *F23R 3/002* (2013.01); *F23R 3/50* (2013.01)

(58) Field of Classification Search

CPC .... F23C 3/00; F23R 3/002; F23R 3/16; F23R 3/50

See application file for complete search history.

(56) References Cited

U.S. PATENT DOCUMENTS

| | | | |
|---|---|---|---|
| 2,540,991 | A | 2/1951 | Price |
| 2,610,467 | A | 9/1952 | Miller |
| 2,641,105 | A | 6/1953 | Drake |
| 2,704,440 | A | 3/1955 | Nicholson |
| 2,821,066 | A | 1/1958 | Clarke et al. |
| 2,833,115 | A | 5/1958 | Clarke et al. |
| 2,913,873 | A | 11/1959 | Murray |
| 3,082,603 | A | 3/1963 | Hering et al. |
| 3,138,930 | A | 6/1964 | Waters et al. |
| 4,158,949 | A | 6/1979 | Reider |
| 4,265,085 | A | 5/1981 | Fox et al. |
| 4,265,615 | A | 5/1981 | Lohmann et al. |
| 4,422,300 | A | 12/1983 | Dierberger et al. |
| 4,996,838 | A | 3/1991 | Melconian |

(Continued)

FOREIGN PATENT DOCUMENTS

DE 102008026463 A1 12/2009

OTHER PUBLICATIONS

Extended European Search Report from EP Application Serial No. 1125012.9; dated Jun. 27, 2011, 6 pages.

*Primary Examiner* — Lorne E Meade
(74) *Attorney, Agent, or Firm* — Kinney & Lange, PA

(57) ABSTRACT

A combustor liner with an input end and an output end includes an annular inner wall and an annular outer wall. At least one of the inner wall and outer wall is three-dimensionally contoured. The inner wall and the outer wall form a combustion chamber with the contours creating alternating expanding and constricting regions inside the chamber causing combustion gases to flow in the circumferential and axial directions.

15 Claims, 6 Drawing Sheets

(56) References Cited

U.S. PATENT DOCUMENTS

| | | | |
|---|---|---|---|
| 5,207,064 | A | 5/1993 | Ciokajlo et al. |
| 5,279,127 | A | 1/1994 | Napoli |
| 5,329,773 | A | 7/1994 | Myers et al. |
| 5,481,867 | A | 1/1996 | Dubell et al. |
| 6,021,570 | A | 2/2000 | Lockyer et al. |
| 6,250,082 | B1 | 6/2001 | Hagle et al. |
| 6,484,505 | B1 | 11/2002 | Brown et al. |
| 6,553,767 | B2 | 4/2003 | Farmer et al. |
| 6,655,147 | B2 | 12/2003 | Farmer et al. |
| 6,701,714 | B2 | 3/2004 | Burd et al. |
| 7,010,921 | B2 | 3/2006 | Intile et al. |
| 7,089,742 | B2 | 8/2006 | Spooner et al. |
| 8,707,708 | B2 | 4/2014 | Wagner et al. |

3D NON-AXISYMMETRIC COMBUSTOR LINER

CROSS-REFERENCE TO RELATED APPLICATION(S)

This application is a continuation of U.S. patent application Ser. No. 14/202,969, filed Mar. 10, 2014, entitled "3D Non-Axisymmetric Combustor Liner", by Joel H. Wagner and Paul M. Lutjen, which is a continuation of U.S. patent application Ser. No. 12/709,951, filed on Feb. 22, 2010, now U.S. Pat. No. 8,707,708, issued on Apr. 29, 2014, entitled "3D Non-Axisymmetric Combustor Liner", by Joel H. Wagner and Paul M. Lutjen, which are incorporated by reference in their entireties.

BACKGROUND

A gas turbine engine extracts energy from a flow of hot combustion gases. Compressed air is mixed with fuel in a combustor assembly of the gas turbine engine, and the mixture is ignited to produce hot combustion gases. The hot gases flow through the combustor assembly and into a turbine where energy is extracted.

Generally there are an array of fuel nozzles between the compressor and the turbine. One type of combustor is a can combustor. In a can combustor, each fuel nozzle goes into a generally cylindrical combustor can, and one combustor can fuels the combustion process for each fuel nozzle. At the output end of the combustor can comes a concentric heated jet of combustion gases that goes into the turbine and produces work. The combustor may include dilution holes and cooling jets to keep the combustor from melting.

Another type of combustor is an annular combustor. An annular combustor generally has a liner with an inner wall and an outer wall, and a combustion chamber in between. At the input end (the compressor end) of the combustor, discrete nozzles are placed in an annular shape to inject fuel and air into the combustion chamber. An annular combustor can include dilution holes and/or dilution jets for cooling and mixing within the combustor. It can also include a thermal barrier coating to prevent the combustor from melting.

SUMMARY

A combustor liner with an input end and an output end includes an annular inner wall and an annular outer wall. At least one of the inner wall and outer wall is three-dimensionally contoured. The inner wall and the outer wall form a combustion chamber with the contours creating alternating expanding and constricting regions inside the chamber causing combustion gases to flow in the circumferential and axial directions.

A method including injecting fuel and air into an annular combustion chamber between inner and outer liner walls of the combustion chamber. It further includes creating localized mixing of the fuel and air in the combustion chamber with three-dimensional contours on at least one of the inner and outer liner walls around the circumference and axially through the length of the combustion chamber, with the contours forming alternating regions of expansion and constriction within the combustor.

DETAILED DESCRIPTION

Figure 1:
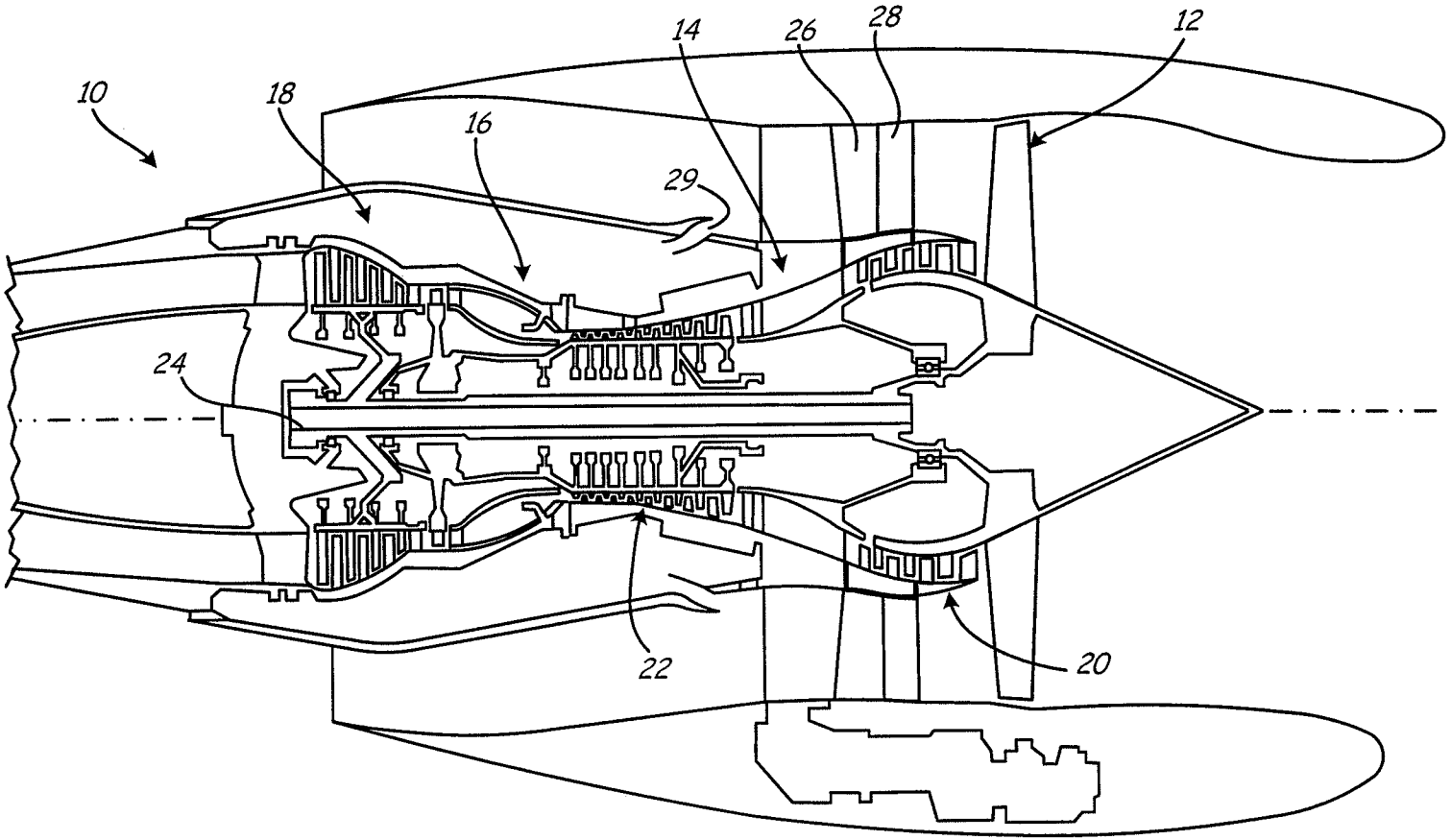
FIG. 1 is a cross-sectional view of a gas turbine engine.

FIG. 1 is a cross-sectional view of gas turbine engine 10, which includes turbofan 12, compressor section 14, combustion section 16 and turbine section 18. Compressor section 14 includes low-pressure compressor 20 and high-pressure compressor 22. Air is taken in through fan 12 as fan 12 spins. A portion of the inlet air is directed to compressor section 14 where it is compressed by a series of rotating blades and vanes. The compressed air is mixed with fuel, and is then inserted into combustor section 16 through nozzles and ignited. The combustion exhaust is directed to turbine section 18. Blades and vanes in turbine section 18 extract energy from the combustion exhaust to turn shaft 24 and provide power output for engine 10. The portion of inlet air that is taken in through fan 12 and not directed through compressor section 14 is bypass air. Bypass air is directed through bypass duct 26 by guide vanes 28. Some of the bypass air flows through opening 29 to cool combustor section 16, high pressure compressor 22 and turbine section 18.

Figure 2:
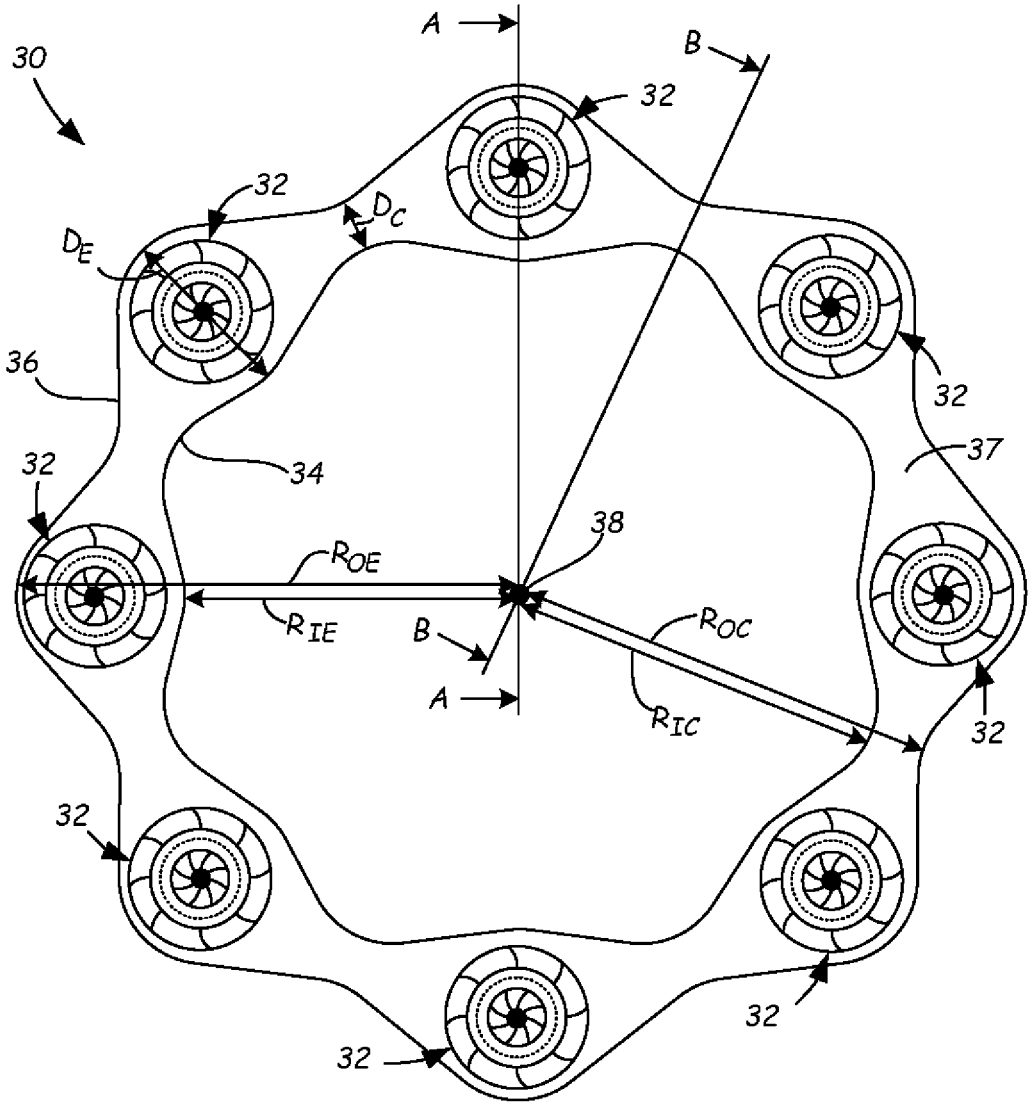
FIG. 2 is an end view of the input end of an annular combustor including a three-dimensionally contoured combustor liner.

FIG. 2 shows an end view of an annular combustor 30 at the input end (compressor end), which includes nozzles 32, combustor liner inner wall 34, combustor liner outer wall 36 and combustion chamber 37. Engine center line 38 and dimensions $R_{IE}$, $R_{OE}$, $R_{IC}$, $R_{OC}$, $D_E$ and $D_C$ are also shown. Nozzles 32 generally are evenly spaced between liner inner wall 34 and liner outer wall 36. Liner inner wall 34 and liner outer wall 36 can be made with cobalt or a nickel alloy and may include a thermal barrier coating. Liner inner and outer walls 34, 36 include three-dimensional contours around the circumference of the inner and outer walls 34, 36 and three-dimensional contours axially through length of the combustion chamber 37 from the input to the output. The three-dimensional contours are generally in a wavelike pattern forming alternating regions of constriction and expansion in combustion chamber 37. The contours around the circumference at the input end of combustor 30 can be seen from the view shown in FIG. 2. At the input end of combustor 30, the contours around the circumference of liner walls 34, 36 form regions of expansion at nozzles 32 and regions of constriction between nozzles 32. $R_{IE}$ is the distance from engine center line 38 to liner inner wall 34 at a region of expansion. $R_{OE}$ is the distance from engine center line to liner outer wall 36 at a region of expansion. $R_{IC}$ is the distance from engine center line 38 to liner inner wall 34 at a region of constriction. $R_{OC}$ is the distance from engine center line to liner outer wall 36 at a region of constriction. $D_E$ is the distance between liner inner wall 34 and liner outer wall 36 at a region of expansion ($R_{OE}$-$R_{IE}$). $D_C$ is the distance between liner inner wall 34 and liner outer wall 36 at a region of constriction ($R_{OC}$-$R_{IC}$). The contours of liner inner wall 34 and liner outer wall 36 generally mirror each other, and can be of the size that $D_C$ (the distance from liner inner wall 34 to liner outer wall 36 at a region of constriction) is about ⅓ to about ⅗ of $D_E$ (the distance from liner inner wall 34 to liner outer wall 36 at a region of expansion), but may be more or less depending on the needs of the particular combustor.

Each nozzle 32 distributes compressed air and fuel into combustor 30, between liner inner wall 34 and liner outer wall 36. The air and fuel distributed is a mixture set for flame holding to promote combustion within the combustion chamber 37. This distribution by nozzles 32 results in very intense heat at each discrete nozzle 32.

When exiting combustor 30, the combusted fuel and air mixture enters turbine section 18 where it comes into contact with first stage high pressure turbine ("HPT") vanes (see FIG. 1). Circumferential variation in the temperature entering turbine 18 leads to variation in distress observed by static hardware in turbine 18. Advanced distress of turbine hardware at a single circumferential location can limit service life of the engine, or time between overhauls. Thus, to maximize service life, a circumferentially prescribed or uniform temperature profile is desirable. Mixing of the air and fuel axially through the length of combustor 30 from input to output can promote a more uniform distribution of temperature (as well as pressure and species) at the output of combustor 30. This uniform distribution of temperature going into the turbine helps to ensure that the progression of distress on turbine hardware is not dependent on circumferential location.

The current invention controls the mixing by adding three-dimensional contours circumferentially and axially through the length of combustor 30 liner inner wall 34 and liner outer wall 36 to form alternating regions of constriction and expansion within combustion chamber 37. In previous combustion chambers, mixing was often done by adding dilution holes or jets to combustor liner walls 34, 36. Dilution holes are holes in liner walls which allow cooler air into the combustor to promote mixing. Dilution jets propel air into the combustor at high velocity to promote mixing in the combustor. The current invention further promotes mixing and controls the flow in combustor 30 by adding three-dimensional contours circumferentially and axially through the length of combustor 30 liner inner wall 34 and liner outer wall 36 to form alternating regions of constriction and expansion within combustion chamber 37.

Figure 3A:
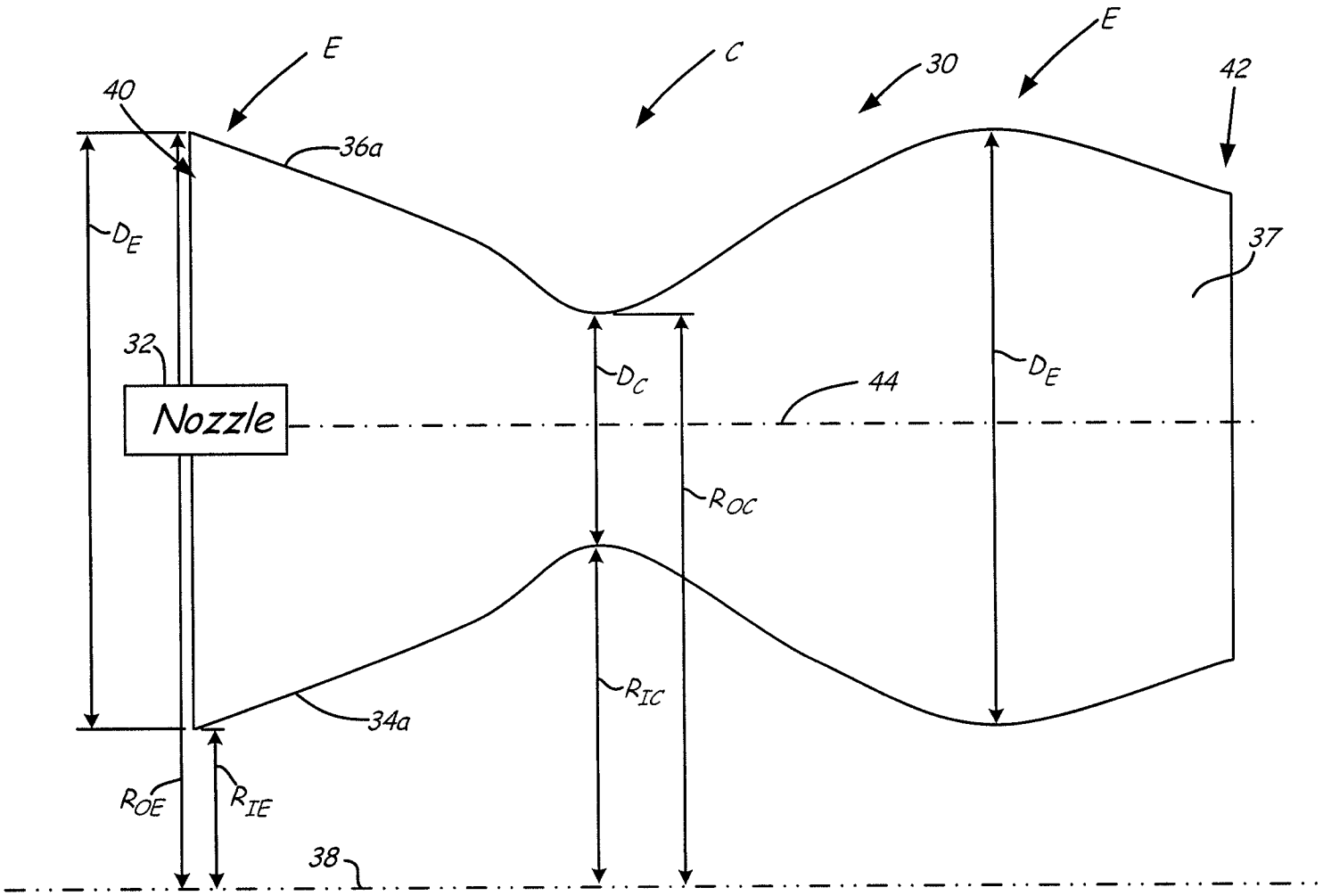
FIG. 3A is a cross-sectional view of a first embodiment of the combustor of FIG. 2 from line A-A.

FIG. 3A is a cross-sectional view of a first embodiment of the combustor of FIG. 2 above engine center line 38 from line A-A (at nozzle 32) of FIG. 2. FIG. 3A includes nozzle 32, three-dimensionally contoured liner inner wall 34*a*, three-dimensionally contoured liner outer wall 36*a*, combustion chamber 37, input end 40, output end 42, nozzle center line of flow 44, regions of expansion E and a region of constriction C. Dimensions $R_{IE}$ (from engine centerline 38 to liner inner wall 34*a* at a region of expansion), $R_{OE}$ (from engine centerline 38 to liner outer wall 36*a* at a region of expansion), $R_{IC}$ (from engine centerline 38 to liner inner wall 34*a* at a region of constriction), $R_{OC}$ (from engine centerline 38 to liner outer wall 36*a* at a region of constriction), $D_E$ (between liner inner wall 34*a* and liner outer wall 36*a* at a region of expansion, $R_{OE}$-$R_{IE}$) and $D_C$ (between liner inner wall 34*a* and liner outer wall 36*a* at a region of constriction, $R_{OC}$-$R_{IC}$) for regions of expansion and constriction are also shown.

An air and fuel mixture is injected into combustion chamber 37 at input end 40 by nozzle 32 at center line of flow 44. This mixture is ignited and travels through combustor to output end 42. As mentioned above, this results in very intense heat downstream of each discrete nozzle 32. To help disburse this heat and control overall mixing, liner inner wall 34*a* and outer wall 36*a* include three-dimensional contours both circumferentially and axially through the length of combustor 30 from input 40 to output 42 to form alternating regions of constriction C and expansion E. These alternating regions of constriction C and expansion E force combustion gases to move circumferentially as well as axially after being injected into combustion chamber 37.

Contoured liner inner wall 34*a* and liner outer wall 36*a* illustrate contours axially through the length of combustor liner at a cross-section where a nozzle 32 is located. Liner inner wall 34*a* and liner outer wall 36*a* form a region of expansion E at input 40. Moving axially toward output 42, liner inner wall 34*a* and liner outer wall 36*a* form a region of constriction C, and then another region of expansion E (in a wavelike pattern). Where the contours bring liner walls together to form a region of constriction C, inner liner wall 34*a* and outer liner wall 36*a* generally mirror each other, and each liner wall (34*a*, 36*a*) can come toward the other about ⅙ to about 1/10 of the distance of $D_E$ (the distance between liner inner wall 34*a* and liner outer wall 36*a* at an expansion region). This results in $D_C$ (the distance between liner inner wall 34*a* and liner outer wall 36*a* at a constriction region C) being about ⅓ to about ⅗ of $D_E$.

Figure 3B:
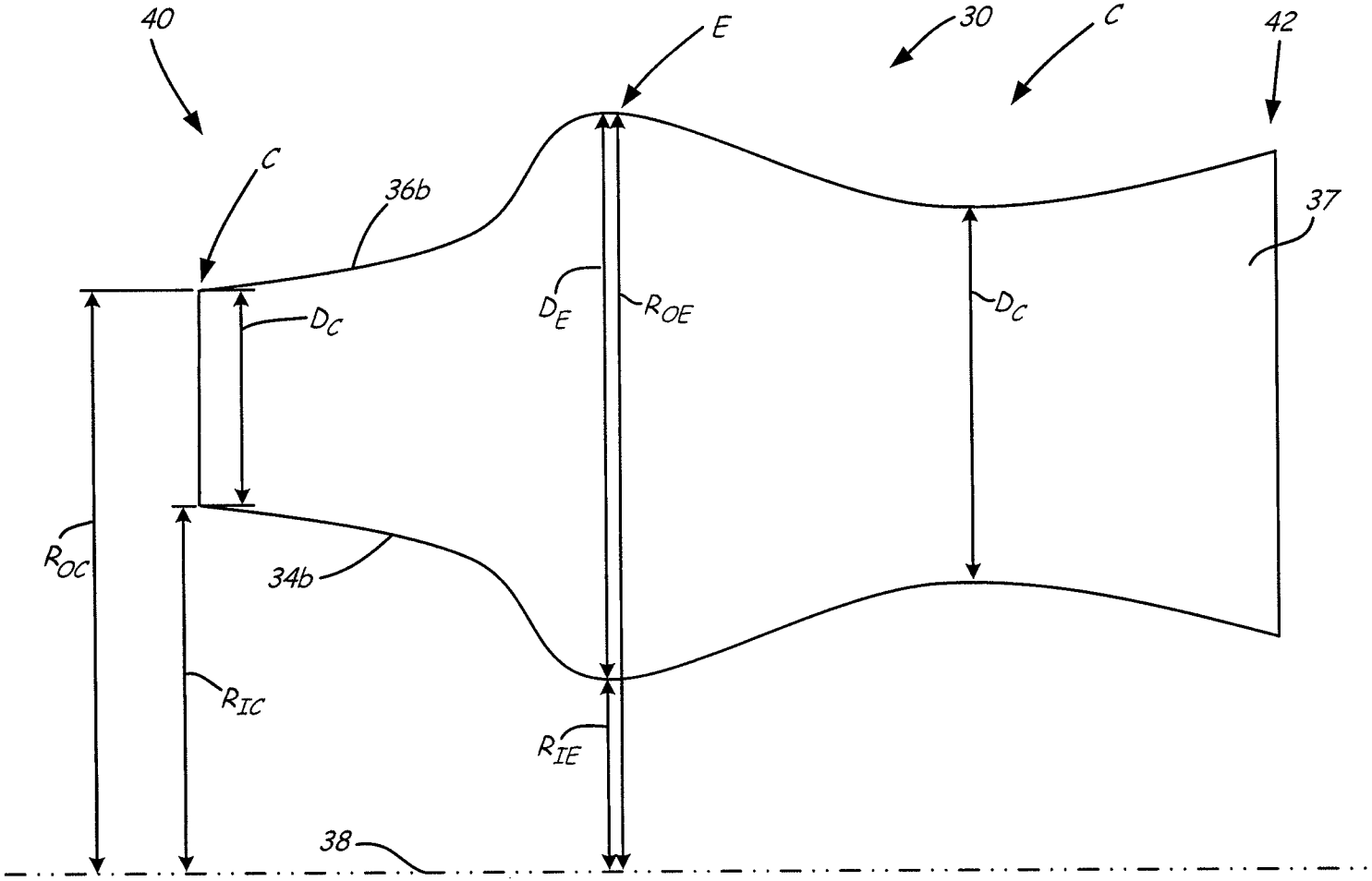
FIG. 3B is a cross-sectional view of a first embodiment of the combustor of FIG. 2 from line B-B.

When liner inner wall 34*a* and liner outer wall 36*a* go from an expansion region E (at input 40) to a constriction region C, some of the flow is forced to move circumferentially within combustion chamber 37 toward circumferentially adjacent expansion zones (such as expansion region E in FIG. 3B). This circumferential flow draws the hot air and fuel mixture distributed by nozzle 32 to areas not directly in front of a nozzle 32, promoting redistribution of combustion gases in less hot areas (areas not directly in front of a nozzle 32).

FIG. 3B is a cross-sectional view of a first embodiment of the combustor of FIG. 2 above engine center line 38 from line B-B (between nozzles) of FIG. 2. FIG. 3B includes three-dimensionally contoured liner inner wall 34*b*, three-dimensionally contoured liner outer wall 36*b*, combustion chamber 37, input end 40, output end 42, and regions of constriction C and a region of expansion E. FIG. 3B further includes dimensions $R_3$ (from engine centerline 38 to liner inner wall 34*b* at a region of expansion), $R_{OE}$ (from engine centerline 38 to liner outer wall 36*b* at a region of expansion), $R_{IC}$ (from engine centerline 38 to liner inner wall 34*b* at a region of constriction), $R_{OC}$ (from engine centerline 38 to liner outer wall 36*b* at a region of constriction), $D_E$ (between liner inner wall 34*b* and liner outer wall 36*b* at a region of expansion, $R_{OE}$-$R_{IE}$) and $D_C$ (between liner inner wall 34*b* and liner outer wall 36*b* at a region of constriction, $R_{OC}$-$R_{IC}$).

Contoured liner inner wall 34*b* and liner outer wall 36*b* illustrate contours axially through the length of combustor liner at a cross-section between where nozzles 32 are located. As can be seen in FIG. 3B, cross-sections between nozzles 32 at input 40 of combustion chamber 37 start with a region of constriction C, followed by a region of expansion E, and then another region of constriction C. As in FIG. 3B, inner liner wall 34*b* and outer liner wall 36*b* generally mirror each other, and each liner wall (34*b*, 36*b*) can be come toward the other about ⅙ to about 1/10 of the distance of $D_E$ (the distance between liner inner wall 34*b* and liner outer wall 36*b* at an expansion region E). This results in $D_C$ (the distance between liner inner wall 34*b* and liner outer wall 36*b* at a constriction region C) being about ⅓ to about ⅗ of $D_E$. The zones of constriction and expansion in FIG. 3B also work to force a circumferential flow of the gases within combustion chamber 37, thereby promoting mixing and a more even distribution of temperature, pressure and species in combustor 30 as gases move from input 40 to output 42.

The cross-sections in FIG. 3A and in FIG. 3B are circumferentially next to each other and work together to promote mixing. As can be seen from FIGS. 3A-3B, when the inner and outer liner walls of FIG. 3A form a region of constriction, the inner and outer liner walls of FIG. 3B form a region of expansion (and vice versa). For example, at combustor 30 input 40, FIG. 3A liner walls 34*a*, 36*a* form a region of expansion and FIG. 3B liner walls 34*b*, 36*b* form a region of constriction. When liner walls in a cross-section go from forming a region of expansion to a region of constriction, the combustion gases will not all be able to travel axially, and some will be forced to travel circumferentially due to the constriction. For example, in FIG. 3A at input 40 liner walls 34*a*, 36*a* form a region of expansion, and at the midpoint between input 40 and output 42 liner walls 34*a*, 36*a* form a region of constriction. As combustion gases travel axially from the zone of expansion to the zone of constriction, some of the gases will be forced to move circumferentially to the region of expansion shown in FIG. 3B at the midpoint between input 40 and output 42. Then as the region of expansion formed by liner walls 34*b*, 36*b* in FIG. 3B goes into a region of constriction near output 42, combustion gases are forced to move circumferentially again to a region of expansion in a neighboring cross-section. This circumferential flow controls mixing and can result in a more even or a prescribed distribution of temperature, pressure and species in combustor 30 as the air and fuel mixture moves axially between input 40 and output 42. Contoured liner walls 34, 36 can also include dilution holes and/or dilution jets (discussed in relation to FIG. 2) to further promote mixing in and aid in cooling combustor 30.

The size and placement of contours on liner inner walls 34 and liner outer walls 36 are shown for example purposes only and may be varied according to combustor needs. Generally, the scale of contours is proportional to the combustor velocity, the velocity at which the fuel and air mixture is distributed from nozzles 32. For example, in a combustor where nozzle 32 distributes air and fuel into combustor 30 at a low velocity (about 0.1 mach), contours which form regions of constriction would have to be larger to promote mixing and control the flow direction (for example, $D_C$ can be about ⅓ of $D_E$) than if nozzle 32 has a higher velocity. If nozzle 32 distributes air and fuel at a high velocity (about 0.3 mach) contours could be smaller (for example, $D_C$ can be about ⅗ of $D_E$).

Figure 4A:
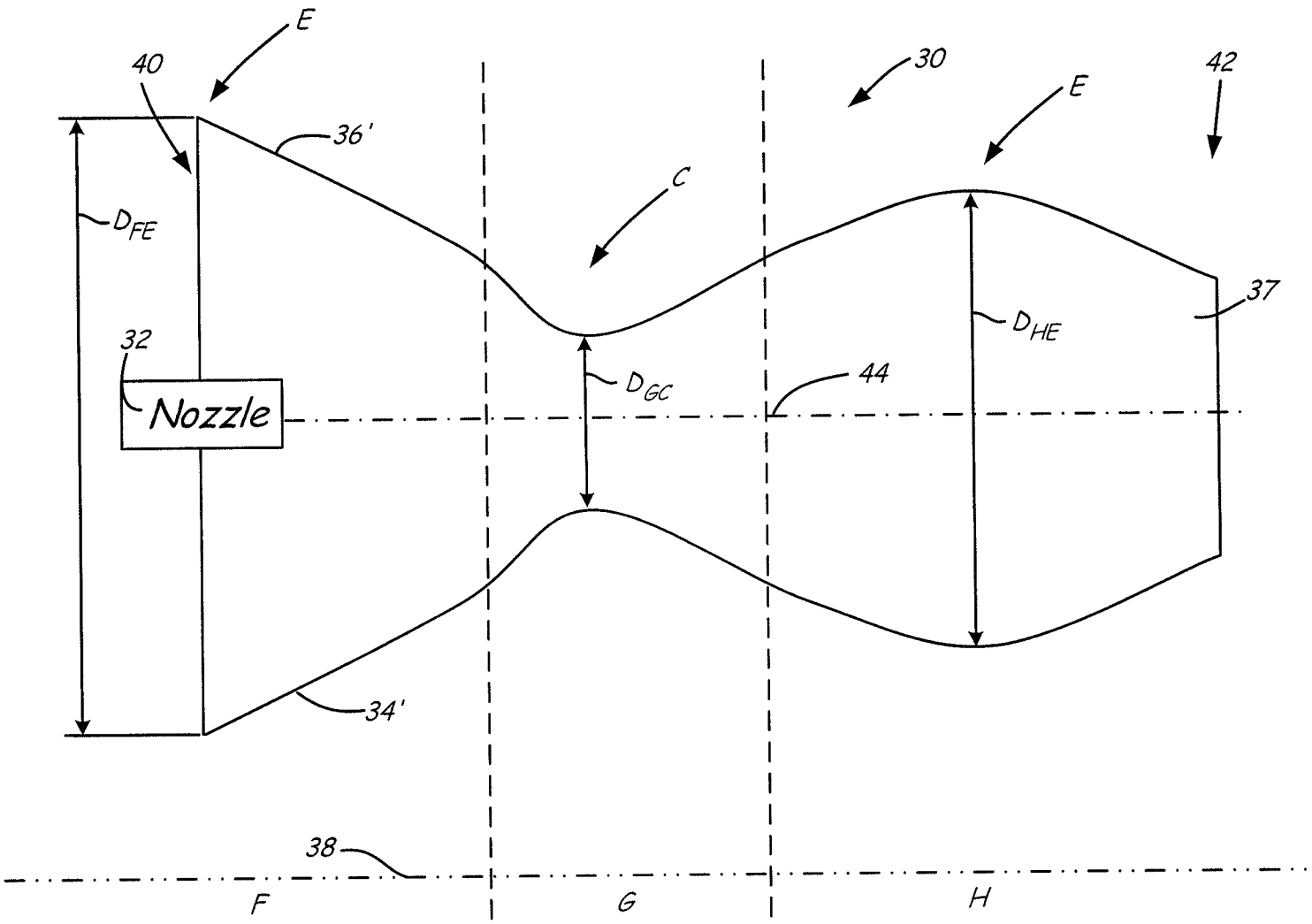
FIG. 4A is a cross-sectional view of a second embodiment of the combustor of FIG. 2 from line A-A.

FIG. 4A illustrates a cross-section of a second embodiment of the combustor of FIG. 2 from line A-A of FIG. 2, having a three-dimensionally contoured liner, with the combustor having a variation in volume from input 40 to output 42, specifically a decrease in volume. Combustor 30 includes nozzle 32; three-dimensionally contoured liner inner wall 34'; three-dimensionally contoured liner outer wall 36'; combustion chamber 37; input end 40; output end 42; nozzle center line of flow 44; axial zones F, G and H; and dimensions $D_{FE}$ (from inner liner wall 34' to outer liner wall 36' at expansion region E in zone F), $D_{GC}$ (from inner liner wall 34' to outer liner wall 36' at constriction region C in zone G), and $D_{HE}$ (from inner liner wall 34' to outer liner wall 36' at expansion region E in zone H).

Figure 4B:
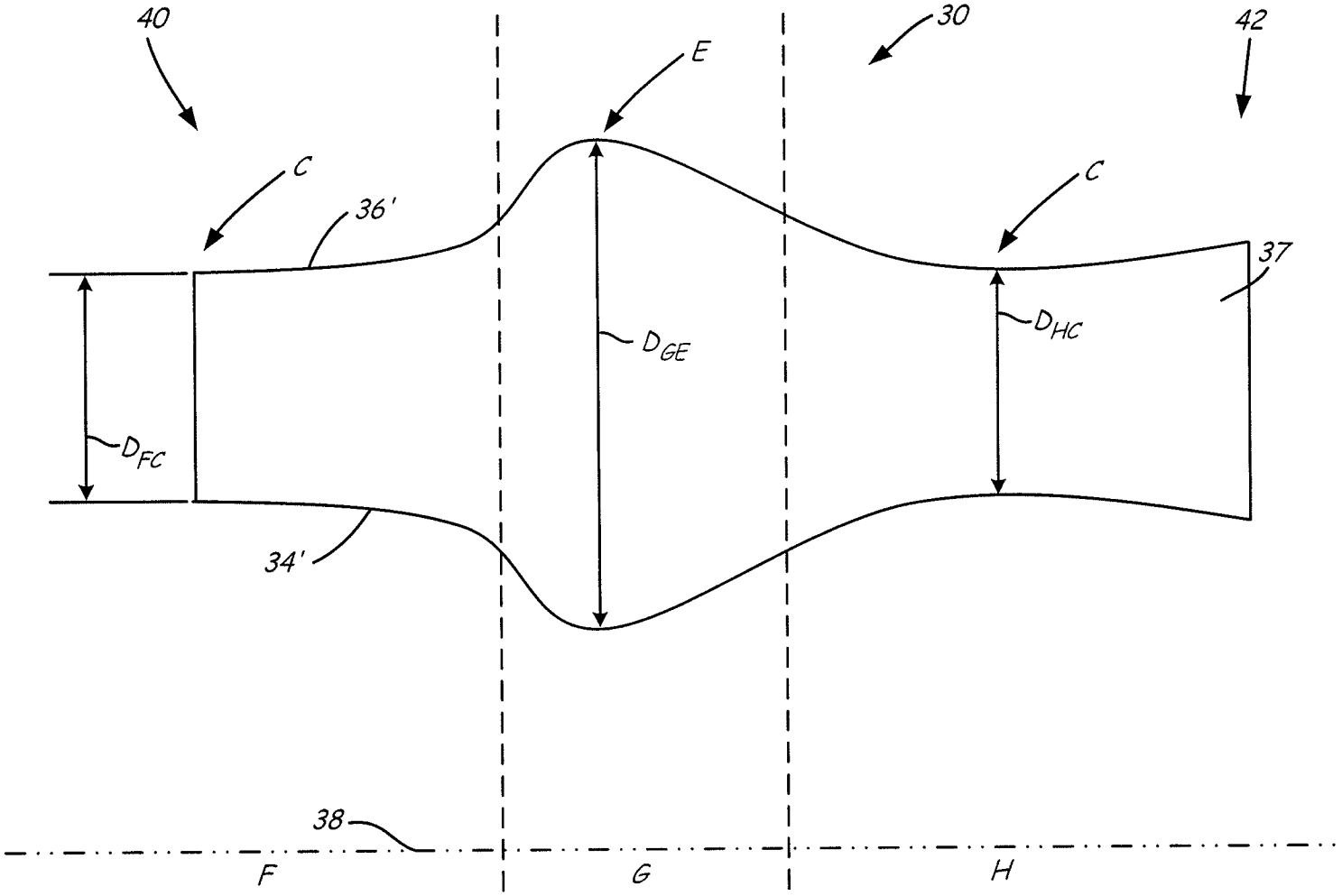
FIG. 4B is a cross-sectional view of a second embodiment of the combustor of FIG. 2 from line B-B.

FIG. 4B illustrates a cross-section of a second embodiment of the combustor of FIG. 2 from line B-B (between nozzles) of FIG. 2. FIG. 4B includes three-dimensionally contoured liner inner wall 34'; three-dimensionally contoured liner outer wall 36'; combustion chamber 37; input end 40; output end 42; axial zones F, G, and H; and distance measurements $D_{FC}$ (from inner liner wall 34' to outer liner wall 36' at constriction region C in zone F), $D_{GE}$ (from inner liner wall 34' to outer liner wall 36' at expansion region E in zone G), and $D_{HC}$ (from inner liner wall 34' to outer liner wall 36' at constriction region C in zone H).

Combustor 30, contoured liner inner walls 34' and contoured liner outer walls 36' work much the same way as discussed in relation to FIGS. 3A-3B, moving flow circumferentially and mixing combustion gases from input 40 to output 42. However, in this embodiment, the combustion chamber 37 experiences a decrease in volume from input 40 to output 42 (as shown through cross-sections F, G, H losing area from input 40 to output 42). Therefore, the distance measurements between liner inner wall 34' and liner outer wall 36' for areas of expansion E are largest in zone F ($D_{FE}$ in FIG. 4A), smaller in zone G ($D_{GE}$ in FIG. 4B), and smallest in zone H ($D_{HE}$ in FIG. 4A).

As the cross-sectional area (and total overall volume) of combustion chamber 37 decreases from input 40 to output 42, this decrease in area would increase the velocity of the combustion gases. As mentioned above, the scale of contours to form regions of constriction C is approximately inversely proportional to the velocity of the combustion gases. Smaller contours (meaning the distance $D_C$ between inner liner wall 34' and outer liner wall 36' is larger in regions of constriction C) can promote mixing when velocity is higher, whereas larger contours (meaning the distance $D_C$ between inner liner wall 34' and outer liner wall 36' is smaller in regions of constriction C) are necessary to promote the same levels of mixing when velocity is lower. Therefore, as the velocity increases from input 40 to output 42 due to the decrease in combustion chamber 37 volume or the addition of dilution and cooling air, the contours forming constriction regions C on liner inner wall 34' and liner outer wall 36' can decrease while still promoting the same levels of mixing. In some combustors, axially through the length from input 40 to output 42 of combustor 30, the contours may diminish to zero or to small values as that might be needed for controlling the flow into the HPT vane (making dimensions $D_E$ and $D_C$ about equal).

In summary, the current invention adds three-dimensional contouring of inner and outer liner walls in a combustor to form alternating regions of constriction and expansion both circumferentially and axially to better control flow coming out of the combustor into the turbine. By controlling flow to promote mixing, an even or prescribed distribution of temperature, pressure and species at the output of the combustor can be achieved. This can prolong engine life by preventing the advanced distress of turbine hardware due to hot spots flowing out of the combustor and into the turbine. This mixing can also promote more efficient combustion in the combustor. The three-dimensional contours may allow for the elimination of some or all dilution holes and/or dilution jets in the combustor liner (previously used to promote mixing).

While the invention has been discussed mainly in reference to promoting and controlling mixing as a means to achieve an even distribution of temperature, pressure and species at the output of the combustor, the three-dimensionally contoured liner could be used in situations where an even distribution is not desired. The three-dimensional wavelike contours forming regions of constriction and expansion can be placed throughout the combustor liner inner wall and liner outer wall to control flow and/or promote mixing in any way desired. While this invention has been discussed mainly in reference to liner inner and liner outer walls each having three-dimensional contours, controlling of the flow and/or mixing can also be done by having three-dimensional contours only on liner inner wall or liner outer wall.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A combustor liner with an input end and an output end, the liner comprising:

an annular inner wall; and an annular outer wall;

wherein at least one of the inner wall and outer wall is three-dimensionally contoured, and the contoured wall is contoured around a circumference and contoured axially along a length of a combustion chamber, and together the inner wall and outer wall form the combustion chamber with the contours creating a circumferentially and axially paired combination of alternating expanding and constricting regions inside the chamber causing combustion gases to flow in the circumferential and axial directions, and each alternating expanding and constricting region creates an axial zone within the combustion chamber;

wherein a first expanding region is circumferentially adjacent to a first constricting region, and wherein the first expanding region and the first constricting region alternate between expanding regions and constricting regions around the entire circumference of the combustion chamber, and wherein the first set of expanding and constricting regions forms a first zone located at the input end;

wherein a second expanding region is circumferentially adjacent to a second constricting region, wherein the second expanding region and the second constricting region alternate between expanding and constricting regions around the entire circumference of the combustion chamber, and wherein each second expanding region is axially downstream from one of the first constricting regions and each second constricting region is axially downstream from one of the first expanding regions, and wherein the second set of expanding and constricting regions forms a second zone located axially downstream from the first zone; and wherein a third expanding region is circumferentially adjacent to a third constricting region, wherein the third expanding region and the third constricting region alternate between expanding and constricting regions around the entire circumference of the combustion chamber, and wherein each third expanding region is axially downstream from one of the second constricting regions and each third constricting region is axially downstream from one of the second expanding regions, and wherein the third set of expanding and constricting regions forms a third zone located axially downstream from the second zone; and wherein distance measurements between the annular inner wall and annular outer wall for regions of expansion are largest at the first zone, smaller at the second zone, and smallest at the third zone; and wherein the contoured wall does not contain a dilution hole.

2. The combustor liner of claim 1, wherein the three-dimensional contours promote localized mixing of gasses flowing from the input end to the output end of the combustion chamber.

3. The combustor liner of claim 1, wherein the combustion chamber experiences a decrease in volume from the input end to the output end.

4. The combustor liner of claim 3, wherein the decrease in volume of the combustion chamber increases a velocity of the combustion gases.

5. A combustor to receive air and fuel at an input end, mix the air and fuel axially through a length of the combustor and distribute the mixture to a turbine at an output end, the combustor comprising:

a combustor liner with an annular wall forming a boundary of a combustion chamber, the annular wall having three-dimensional non-axisymmetric contours in a wavelike pattern located circumferentially around the annular wall and axially substantially through the length of the annular wall, creating a circumferentially and axially paired combination of alternating expanding and constricting regions inside the combustion chamber to cause combustion gases to flow in the circumferential and axial directions, wherein each alternating expanding and constricting region creates an axial zone within the combustion chamber;

wherein the combustor liner does not include a dilution hole.

6. The combustor of claim 5, and further comprising:

a plurality of nozzles to distribute the fuel into the combustion chamber at the input end of the combustor.

7. The combustor of claim 6, wherein the contours around the circumference of the annular wall form regions of constriction at locations between the nozzles such that a radial distance between the annular inner wall and annular outer wall are about ⅓ to ⅗ of a distance from the annular inner wall to the annular outer wall at regions of expansion.

8. The combustor of claim 6, wherein the contours around the circumference of the annular wall form regions of expansion at the nozzles such that radial distance measurements between the annular inner wall and annular outer wall for regions of expansion are largest at a first zone, smaller at a second zone, and smallest at a third zone.

9. The combustor of claim 5, wherein the three-dimensional non-axisymmetric contours are configured to promote localized mixing of the air and fuel in the combustor.

10. The combustor of claim 5, wherein the combustor experiences a decrease in volume from the input end to the output end.

11. The combustor of claim 10, wherein the decrease in volume of the combustor increases a velocity of the combustion gases.

12. The combustor of claim 5, wherein at the output end of the combustor, the mixing has created a generally uniform distribution of temperature and pressure in the mixture to ensure that the progression of distress on turbine hardware is not dependent on circumferential location.

13. A method comprising:

injecting fuel and air into an annular combustion chamber at an input end; and creating localized mixing of the fuel and air in the combustion chamber with three-dimensional contours on a liner wall around a circumference and axially through a length of the annular combustion chamber, with the contours forming a circumferentially and axially paired combination of alternating regions of expansion and constriction within the annular combustion chamber to cause combustion gases to flow in both circumferential and axial directions;

wherein creating localized mixing of the fuel and air with three-dimensional contours mixes the fuel and air for combustion without dilution holes in the liner wall injecting additional air into the annular combustion chamber.

14. The method of claim 13, wherein the step of injecting fuel and air into an annular combustion chamber at the input end further comprises:

distributing air and fuel from nozzles into the annular combustion chamber at a velocity less than 0.3 mach, such that the localized mixing occurs when a radial distance across the combustion chamber in at least one of the regions of constriction is about ⅓ of a radial distance across the annular combustion chamber in at least one of the regions of expansion.

15. The method of claim 13, wherein the step of injecting fuel and air into an annular combustion chamber at the input end further comprises:

distributing air and fuel from nozzles into the annular combustion chamber at a velocity of about 0.3 mach, such that the localized mixing occurs when a radial distance across the combustion chamber in at least one of the regions of constriction is about ⅗ of a radial distance across the combustion chamber in at least one of the regions of expansion.

* * * * *